US010993597B2

(12) United States Patent
Zhang

(10) Patent No.: US 10,993,597 B2
(45) Date of Patent: May 4, 2021

(54) CLAMPING-TYPE DUST SUCTION TUBE OF VACUUM CLEANER, AND HAND-HELD VACUUM CLEANER

(71) Applicant: Suzhou Aijian Electric Appliance Co., Ltd., Jiangsu (CN)

(72) Inventor: Yuqi Zhang, Jiangsu (CN)

(73) Assignee: Suzhou Aijian Electric Appliance Co., Ltd., Jiangsu (CN)

( * ) Notice: Subject to any disclaimer, the term of this patent is extended or adjusted under 35 U.S.C. 154(b) by 380 days.

(21) Appl. No.: 16/073,806

(22) PCT Filed: Sep. 22, 2016

(86) PCT No.: PCT/CN2016/099667
§ 371 (c)(1),
(2) Date: Jul. 30, 2018

(87) PCT Pub. No.: WO2017/128741
PCT Pub. Date: Aug. 3, 2017

(65) Prior Publication Data

US 2019/0029484 A1 Jan. 31, 2019

(30) Foreign Application Priority Data

Jan. 29, 2016 (CN) ..... 201610064264.2

(51) Int. Cl.
*A47L 9/24* (2006.01)
*A47L 5/24* (2006.01)
*A47L 9/00* (2006.01)

(52) U.S. Cl.
CPC ..... *A47L 9/244* (2013.01); *A47L 5/24* (2013.01); *A47L 9/0009* (2013.01); *A47L 9/24* (2013.01); *A47L 9/246* (2013.01)

(58) Field of Classification Search
CPC ..... A47L 9/244; A47L 9/24; A47L 9/0009; A47L 5/24; A47L 9/246; A47L 9/242; A47L 9/248; A47L 5/28
See application file for complete search history.

(56) References Cited

U.S. PATENT DOCUMENTS 3,950,014 A * 4/1976 Doubleday ..... A47L 9/242 285/7
2007/0295571 A1 12/2007 Tong

FOREIGN PATENT DOCUMENTS

| | | |
|---|---|---|
| CN | 1293942 | 5/2001 |
| JP | H11-070066 | 3/1999 |
| WO | WO2014/174248 | * 10/2014 |

OTHER PUBLICATIONS

"International Search Report (Form PCT/ISA/210)", dated Nov. 30, 2016, with English translation thereof, pp. 1-6.

* cited by examiner

*Primary Examiner* — David Redding
(74) *Attorney, Agent, or Firm* — JCIPRNET

(57) ABSTRACT

Disclosed are a clamping-type dust suction tube of a vacuum cleaner and a hand-held vacuum cleaner. The clamping-type dust suction tube includes a tube body and a conductive assembly arranged within the tube body, the tube body includes a plurality of sub-tubes connected in a butt joint manner to form a whole tube, joints arranged at joint portions of every two sub-tubes, and locking mechanisms arranged on the joints and used for locking every two sub-tubes with respect to each other, wherein the length of each sub-tube is less than or equal to a length, a width or a height of other components of the vacuum cleaner. The whole clamping-type dust suction tube is convenient for (Continued)

assembly and carry, reduces the volume of the package, and in addition, it is simple in structure, convenient to implement, and low in cost.

9 Claims, 8 Drawing Sheets

CLAMPING-TYPE DUST SUCTION TUBE OF VACUUM CLEANER, AND HAND-HELD VACUUM CLEANER

CROSS-REFERENCE TO RELATED APPLICATION

This application is a 371 application of an international PCT application Ser. No. PCT/CN2016/099667, filed on Sep. 22, 2016, which claims priority to and the benefit of China Patent Application No. 201610064264.2, filed on Jan. 29, 2016. The entirety of each of the above-mentioned patent applications is hereby incorporated by reference herein and made a part of this specification.

TECHNICAL FIELD OF THE INVENTION

The present disclosure relates to a hand-held vacuum cleaner, and meanwhile to a clamping-type dust suction tube of a vacuum cleaner.

BACKGROUND OF THE INVENTION

As is well known, a hand-held vacuum cleaner basically comprises a main vacuum cleaner body, a dust suction head (ground brush), and a dust suction tube connecting the dust suction head and the main vacuum cleaner body, wherein the dust suction tube is further provided with a conductive assembly therein, and under the control of the main vacuum cleaner body, the electric power is directed to the dust suction head through the conductive assembly, so that the dust suction head starts to work.

However, the current dust suction tube is a whole section, and the size and the length of the tube is larger than the lengths or widths of the main vacuum cleaner body and the dust suction head, so it is very inconvenient from the perspective of carrying, and so it is difficult to be favored by consumers; at the same time, it brings great inconvenience to the package for sale.

SUMMARY OF THE INVENTION

The technical problems to be solved by the present disclosure is to overcome the shortcomings of the prior art, and to provide an improved clamping-type dust suction tube of a vacuum cleaner.

And meanwhile, the present disclosure further provide an improved hand-held vacuum cleaner.

To solve the above problems, the present disclosure employs the following technical solution:

A clamping-type dust suction tube of a vacuum cleaner comprises a tube body and a conductive assembly arranged within the tube body, the tube body comprises a plurality of sub-tubes butt-jointed to form a whole tube, joints arranged at joint portions of every two sub-tubes of the sub-tubes, and locking mechanisms arranged on the joints and used for locking every two sub-tubes of the sub-tubes with respect to each other, wherein the length of each sub-tube is less than or equal to a length, a width or a height of other components of the vacuum cleaner.

Preferably, the joints comprise a first joint and a second joint arranged respectively at two end portions of each sub-tube, wherein the first joint is provided with a positioning slot thereon, and the second joint is provided with a positioning pin thereon capable of cooperating with the positioning slot.

According to a specific implementation and a preferred aspect of the present disclosure, the locking mechanism comprises a locking groove arranged on any one of the first joint and the second joint, and a locking element arranged on the other one of the first joint and the second joint and capable of cooperating with the locking groove.

Preferably, the locking element is arranged on the first joint, the locking groove is arranged on the second joint, and the locking element comprises a locking seat arranged on the first joint and a locking pin movably arranged within the locking seat and capable of inserting into the locking groove.

Further, the locking mechanism further comprises an unlocking button arranged on the locking seat rotationally around a middle portion and an restoring elastic member, the locking pin is arranged at one end portion of the unlocking button, the restoring elastic member is located on the other end portion of the unlocking button and arranged between the unlocking button and the locking seat, and when the unlocking button is pressed, the restoring elastic member is compressed and deformed, the locking pin moves outside the locking seat and is disengaged from the locking grooves, and achieve unlocking; when the unlocking button is released, the restoring elastic member recovers from deformation, the locking pin moves towards inside the locking seat and is inserted into the locking groove, and achieve locking.

Further, a press groove is further arranged on the end portion of the unlocking button away from the locking pin. It is easy to operate and prevents hand to slip.

Preferably, the locking seat is provided protruding from an external end surface of the first joint, the positioning slot is arranged on an end portion of the locking seat protruding from the external end surface of the first joint, and extends along a length direction of the sub-tube, the second joint sinks inwardly from a connection end surface to form a recess to avoid a portion of the locking seat protruding from the external end surface of the first joint, the positioning pin is arranged within the recess, and the end portion of the positioning pin is arranged flush with the connection end surface.

Preferably, the length of the positioning slot, the length of the positioning pin and the length of the locking seat protruding from the external end surface of the first joint are equal to each other. It enables that the two sub-tubes are relatively clamped and completely pressed against each other from the connection end surfaces, enhancing the stability of the butt-jointed clamping-type dust suction tube.

According to another specific implementation and another preferred aspect of the present disclosure, the conductive assembly comprises a conductive portion arranged within each sub-tube extending along the length of the sub-tube respectively, and a conductive thrusting needle and a conductive socket are respectively arranged at two end portions of each sub-tube, wherein the conductive thrusting needle and the conductive socket are connected via the conductive portion, and the thrusting needle of a previous sub-tube is inserted into the conductive socket of a following sub-tube when the two sub-tubes are butt-jointed.

Another technical solution employed by the present disclosure is as follows:

A hand-held vacuum cleaner comprises a vacuum cleaner body, a dust suction head and the above-mentioned clamping-type dust suction tube, wherein two end portions of the clamping-type dust suction tube are communicated with the vacuum cleaner body and the dust suction head, respectively.

Due to the implementation of the above technical solutions, the present disclosure has the following advantages over the prior art:

The invention divides the whole dust suction tube into a plurality of sections convenient for assembly, thereby being convenient to carry, and also reduces the volume of the package for sale, leaving a good impression to the consumer, and in addition, it is simple in structure, convenient to implement, and low in cost.

BRIEF DESCRIPTION OF THE DRAWINGS

In the following, the present disclosure is further explained in detail combining with the accompanying drawings and specific embodiments.

wherein: 1—vacuum cleaner body;

2—dust suction head;

3—clamping-type dust suction tube; 30—tube body; 30*a*—sub-tube; 30*b*—joint; 301*b*—first joint; 302*b*—second joint; 30*c*—locking mechanism; 300*c*—locking groove; 301*c*—locking element; e—locking seat; f—locking pin; 302*c*—unlocking button; g—press groove; 303*c*—restoring elastic element; c—positioning slot; d—positioning pin; h—recess; 31—conductive assembly; 310—conductive portion; 311—conductive thrusting needle; 312—conductive socket.

DETAILED DESCRIPTION OF EXEMPLARY EMBODIMENTS

Figure 1:
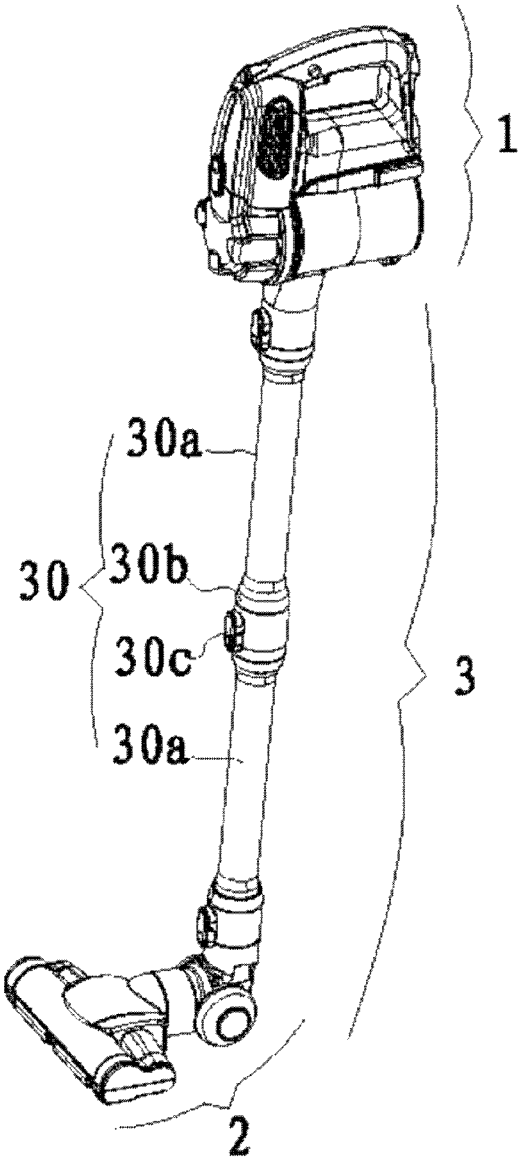
FIG. 1 is a schematic structure diagram of a hand-held vacuum cleaner according to the present disclosure.
Figure 2:
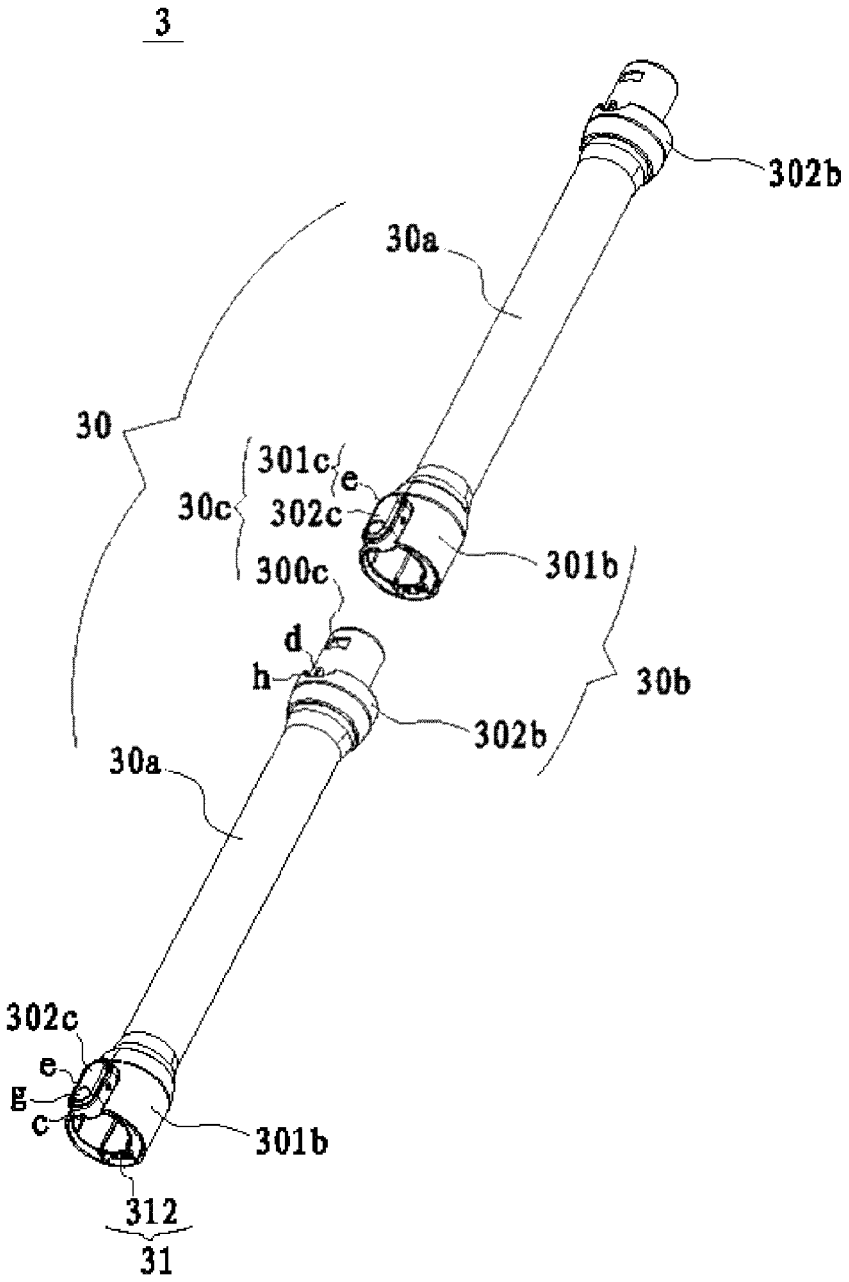
FIG. 2 is a schematic exploded view of a clamping-type dust suction tube (two sections for example) in FIG. 1.
Figure 3:
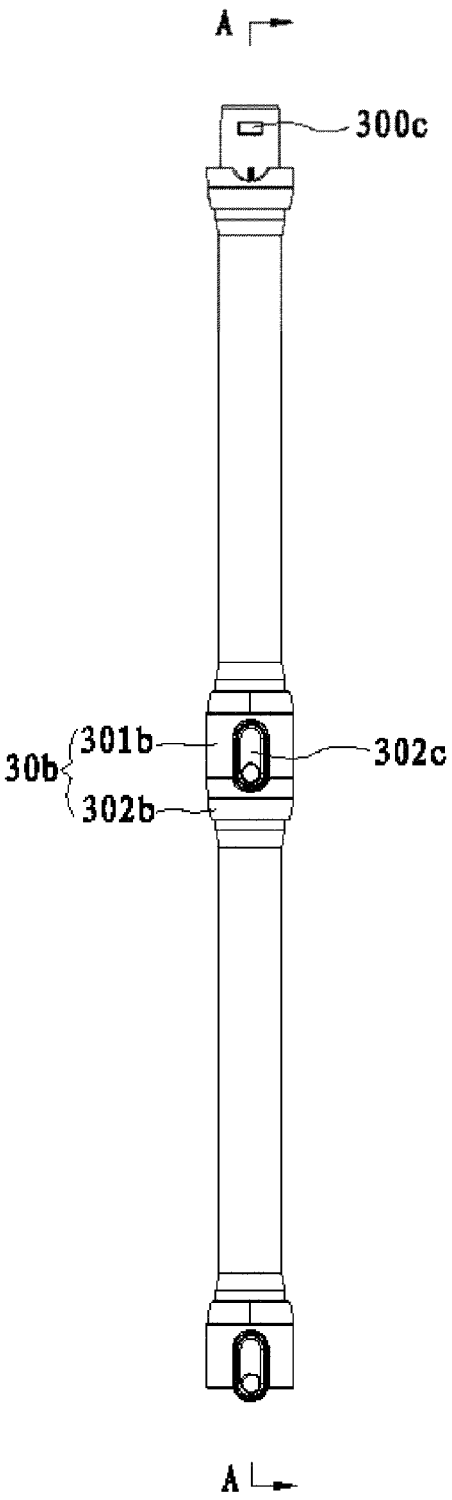
FIG. 3 is a schematic main view of the clamping-type dust suction tube in FIG. 1.
Figure 4:
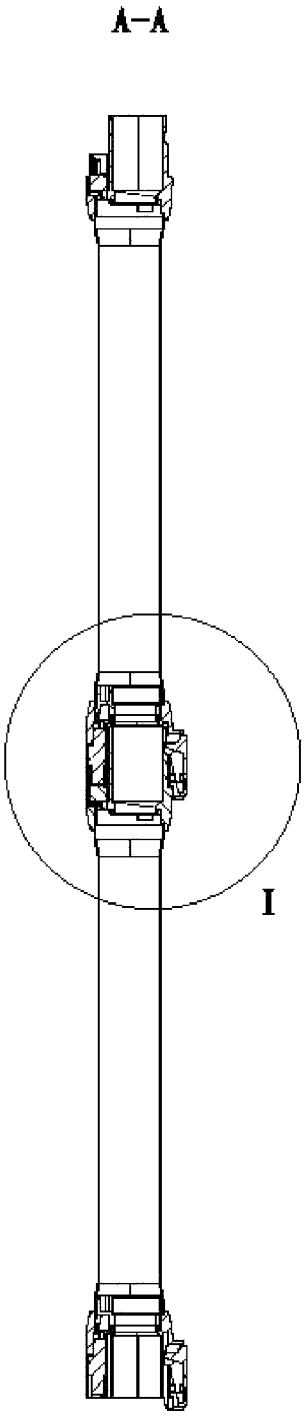
FIG. 4 is a schematic sectional view along Line A-A in FIG. 3.
Figure 5:
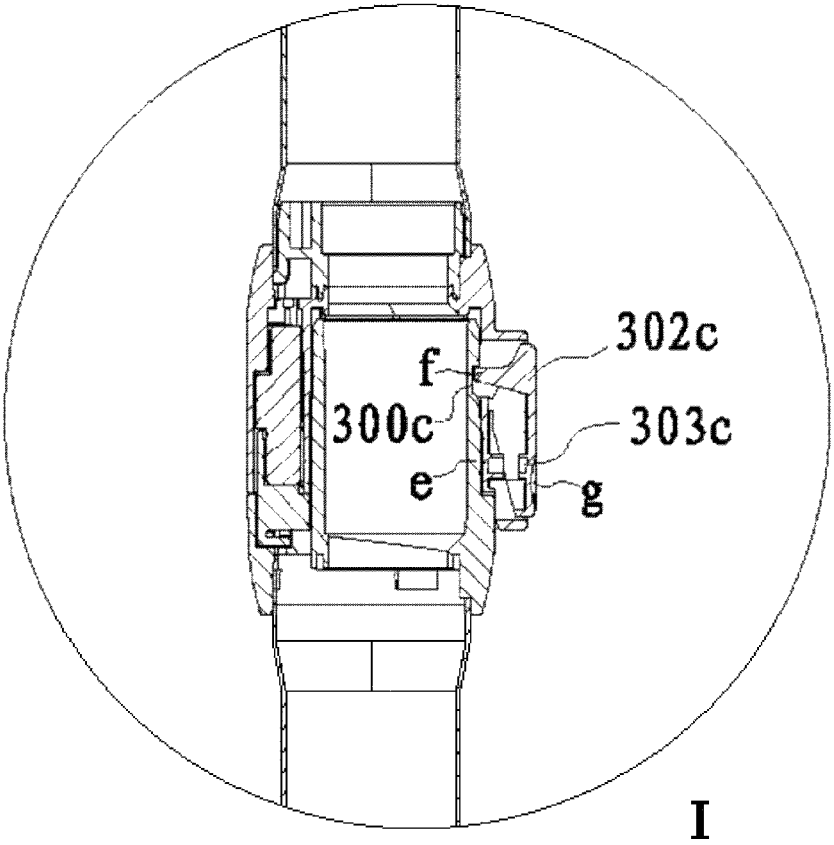
FIG. 5 is an enlarged schematic view of Portion I in FIG. 4.
Figure 6:
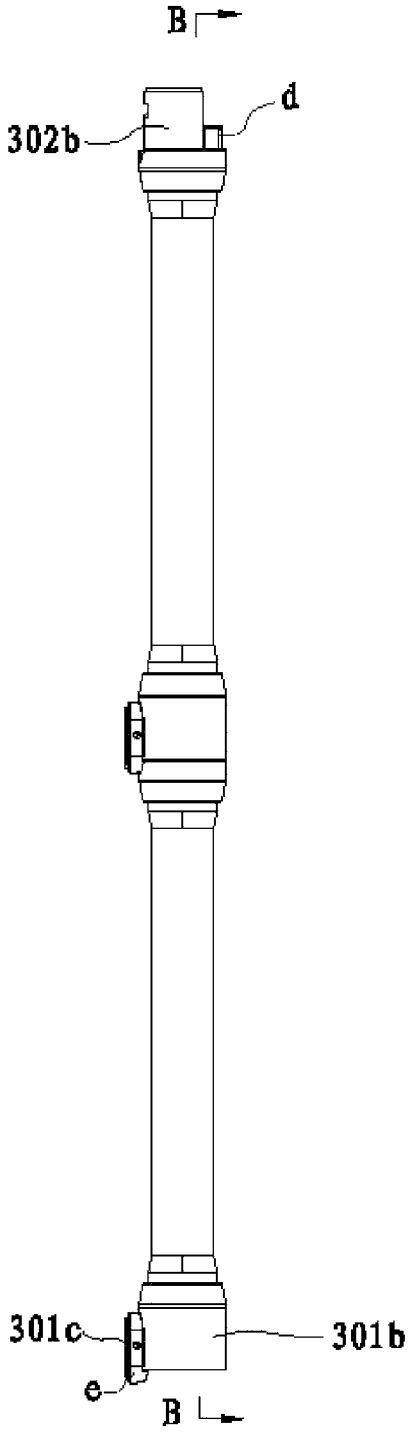
FIG. 6 is a schematic left view of FIG. 3.
Figure 7:
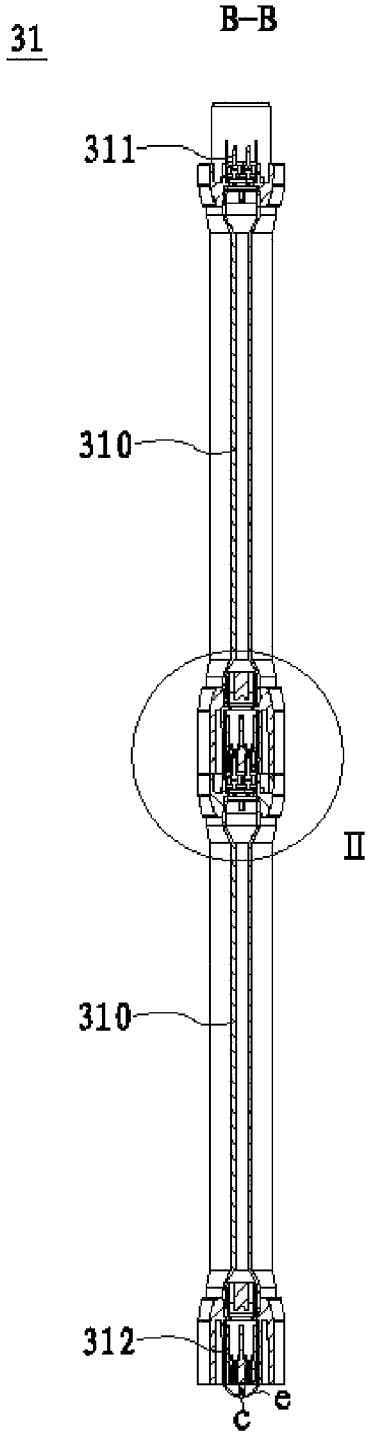
FIG. 7 is a schematic sectional view along Line B-B in FIG. 6.
Figure 8:
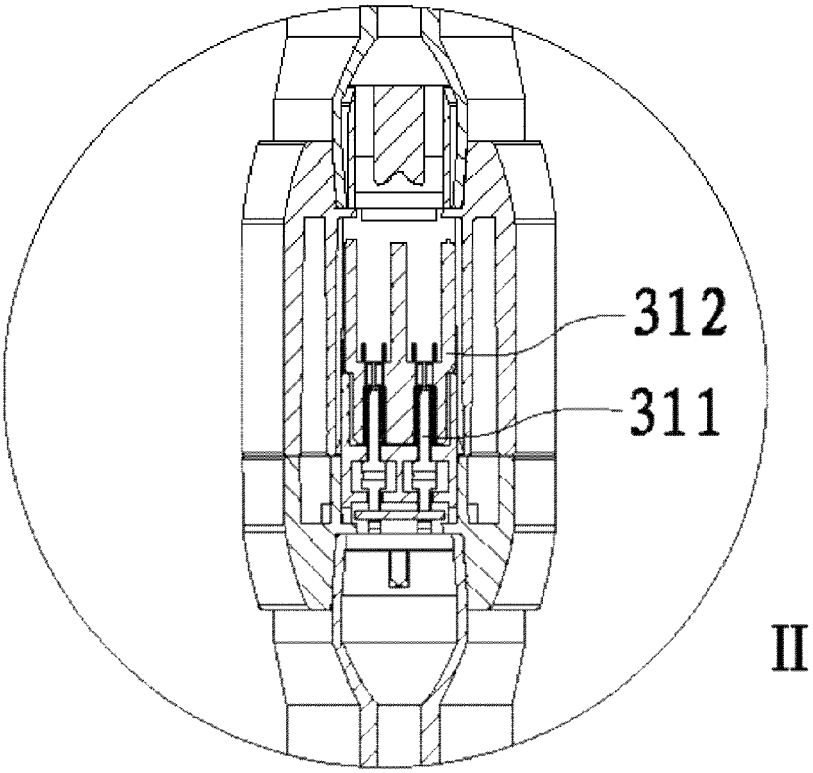
FIG. 8 is an enlarged schematic view of Portion II in FIG. 7.

As shown in FIG. 1 to FIG. 8, a hand-held vacuum cleaner of the present embodiment comprises a vacuum cleaner body 1, a dust suction head 2 and a clamping-type dust suction tube 3, wherein two end portions of the clamping-type dust suction tube 3 are communicated with the vacuum cleaner body 1 and the dust suction head 2, respectively.

The clamping-type dust suction tube 3 comprises a tube body 30 and a conductive assembly 31 arranged within the tube body 30, the tube body 30 comprises a plurality of sub-tubes 30*a* butt-jointed to form a whole tube, joints 30*b* arranged at joint portions of every two sub-tubes 30*a*, and locking mechanisms 30*c* arranged on the joints 30*b* and used for locking every two sub-tubes 30*a* with respect to each other, wherein the length of each sub-tube 30*a* is less than or equal to a length, a width or a height of other components of the vacuum cleaner.

In the present embodiment, the joints 30*b* comprise a first joint 301*b* and a second joint 302*b* arranged respectively at two end portions of each sub-tube 30*a*, wherein the first joint 301*b* is provided with a positioning slot c thereon, and the second joint 302*b* is provided with a positioning pin d thereon capable of cooperating with the positioning slot c.

The locking mechanism 30*c* comprises a locking groove 300*c* arranged on the second joint 302*b*, and a locking element 301*c* arranged on the first joint 301*b* and capable of cooperating with the locking groove 300*c*.

The locking element 301*c* comprises a locking seat e arranged on the first joint 301*b* and a locking pin f movably arranged within the locking seat e and capable of inserting into the locking groove 300*c*.

In the present embodiment, the locking mechanism 30*c* further comprises an unlocking button 302*c* arranged on the locking seat e rotationally around a middle portion and an restoring elastic member 303*c* , the locking pin f is arranged at one end portion of the unlocking button 302*c* and the restoring elastic member 303*c* is located on the other end portion of the unlocking button 302*c* and arranged between the unlocking button 302*c* and the locking seat e, and when the unlocking button 302*c* is pressed, the restoring elastic member 303*c* is compressed and deformed, the locking pin f moves outside the locking seat e and is disengaged from the locking grooves 300*c*, and achieve unlocking; when the unlocking button 302*c* is released, the restoring elastic member 303*c* recovers from deformation and the locking pin f moves towards inside the locking seat e and is inserted into the locking groove 300*c*, and achieve locking.

Further, a press groove g is further arranged on the end portion of the unlocking button 302*c* away from the locking pin f. It is easy to operate and prevents hand to slip. The locking pin f and the unlocking button 302*c* are formed integrally.

Meanwhile, the locking seat e is provided protruding from an external end surface of the first joint 301*b*, the positioning slot c is arranged on an end portion of the locking seat e protruding from the external end surface of the first joint 301*b*, and extends along a length direction of the sub-tube 30*a*, the second joint 302*b* sinks inwardly from a connection end surface to form a recess h to avoid a portion of the locking seat e protruding from the external end surface of the first joint 301*b*, the positioning pin d is arranged within the recess h, and the end portion of the positioning pin d is arranged flush with the connection end surface.

The length of the positioning slot c, the length of the positioning pin d and the length of the locking seat e protruding from the external end surface of the first joint 301*b* are equal to each other. It enables that the two sub-tubes are relatively clamped and completely pressed against each other from the connection end surfaces, enhancing the stability of the butt-jointed clamping-type dust suction tube.

In addition, in the present embodiment, the conductive assembly 31 comprises a conductive portion 310 arranged within each sub-tube 30*a* extending along the length of the sub-tube respectively, and a conductive thrusting needle 311 and a conductive socket 312 are respectively arranged at two end portions of each sub-tube 30*a*, wherein the conductive thrusting needle 311 and the conductive socket 312 are connected via the conductive portion 310, and the thrusting needle 311 of a previous sub-tube 30*a* is inserted into the conductive socket 312 of a following sub-tube 30*a* when the two sub-tubes 30*a* are butt-jointed. It is very convenient for the electrical connection of the vacuum cleaner, and it has a relatively high safety coefficient and a long service life.

Above all, the present embodiment has the following advantages:

1) The sub-tubes clamped end-to-end are employed to form a whole dust suction tube, and the length of the sub-tubes is relatively short, thereby being convenient to carry, and also reduces the volume of the package for sale, leaving a good impression to the consumer.

2) A unique locking mechanism is employed to lock and clamp the first joint and the second joint of two sub-tubes with respect to each other, when the unlocking button is pressed, the restoring elastic member is compressed and deformed, the locking pin moves outside the locking seat and is disengaged from the locking grooves, achieve unlocking; when the unlocking button is released, the restoring elastic member recovers from deformation, the locking pin moves towards inside the locking seat and is inserted into the locking groove, achieve locking automatically. The entire process is easy to operate, convenient to implement, and has a low cost.

3) Employing the built-in conductive assembly to achieve the electrical connection of the vacuum cleaner, and meanwhile by the cooperation of the conductive thrusting needle and the conductive socket respectively arranged on the two end portions of the sub-tube, the connection of the circuit is achieved when the plurality of sub-tubes are butt-jointed, and it is very convenient, has a relatively high safety coefficient and a long service life.

The above detailed describes the present disclosure, and is intended to make those skilled in the art being able to understand the present disclosure and thereby implement it, and should not be concluded to limit the protective scope of this disclosure. Any equivalent variations or modifications according to the spirit of the present disclosure should be covered by the protective scope of the present disclosure.

What is claimed is:

1. A clamping-type dust suction tube of a vacuum cleaner, comprising a tube body and a conductive assembly arranged within the tube body, wherein the tube body comprises a plurality of sub-tubes butt-jointed to form a whole tube, joints arranged at joint portions of every two sub-tubes of the sub-tubes, and locking mechanisms arranged on the joints and used for locking every the two sub-tubes of the sub-tubes with respect to each other, wherein a length of each sub-tube is less than or equal to a length, a width or a height of other components of the vacuum cleaner wherein the joints comprise a first joint and a second joint arranged respectively at two end portions of each sub-tube, wherein the first joint is provided with a positioning slot thereon, and the second joint is provided with a positioning pin thereon capable of cooperating with the positioning slot.

2. The clamping-type dust suction tube of a vacuum cleaner as claimed in claim 1, wherein the locking mechanism comprises a locking groove arranged on any one of the first joint and the second joint, and a locking element arranged on the other one of the first joint and the second joint and capable of cooperating with the locking groove.

3. The clamping-type dust suction tube of a vacuum cleaner as claimed in claim 2, wherein the locking element is arranged on the first joint, the locking groove is arranged on the second joint, and the locking element comprises a locking seat arranged on the first joint and a locking pin movably arranged within the locking seat and capable of inserting into the locking groove.

4. The clamping-type dust suction tube of a vacuum cleaner as claimed in claim 3, wherein the locking mechanism further comprises an unlocking button arranged on the locking seat rotationally around a middle portion and an restoring elastic member, the locking pin is arranged at one end portion of the unlocking button, and the restoring elastic member is located on the other end portion of the unlocking button and arranged between the unlocking button and the locking seat, and when the unlocking button is pressed, the restoring elastic member is compressed and deformed, the locking pin moves outside the locking seat and is disengaged from the locking grooves, and achieve unlocking; when the unlocking button is released, the restoring elastic member recovers from deformation, the locking pin moves towards inside the locking seat and is inserted into the locking groove, and achieve locking.

5. The clamping-type dust suction tube of a vacuum cleaner as claimed in claim 4, wherein a press groove is further arranged on the end portion of the unlocking button away from the locking pin.

6. The clamping-type dust suction tube of a vacuum cleaner as claimed in claim 3, wherein the locking seat is provided protruding from an external end surface of the first joint, the positioning slot is arranged on an end portion of the locking seat protruding from the external end surface of the first joint, and extends along a length direction of the sub-tube, the second joint sinks inwardly from a connection end surface to form a recess to avoid a portion of the locking seat protruding from the external end surface of the first joint, the positioning pin is arranged within the recess, and the end portion of the positioning pin is arranged flush with the connection end surface.

7. The clamping-type dust suction tube of a vacuum cleaner as claimed in claim 6, wherein a length of the positioning slot, a length of the positioning pin and a length of the locking seat protruding from the external end surface of the first joint are equal to each other.

8. The clamping-type dust suction tube of a vacuum cleaner as claimed in claim 1, wherein the conductive assembly comprises a conductive portion arranged within each sub-tube extending along the length of the sub-tube respectively, and a conductive thrusting needle and a conductive socket are respectively arranged at two end portions of each sub-tube, wherein the conductive thrusting needle and the conductive socket are connected via the conductive portion, and the thrusting needle of the previous sub-tube is inserted into the conductive socket of the following sub-tube when the two sub-tubes are butt-jointed.

9. A hand-held vacuum cleaner, comprising a vacuum cleaner body and a dust suction head, wherein the hand-held vacuum cleaner further comprises the clamping-type dust suction tube of claim 1, wherein two end portions of the clamping-type dust suction tube are communicated with the vacuum cleaner body and the dust suction head, respectively.

* * * * *